United States Patent [19]

Elliston

[11] 4,257,456

[45] Mar. 24, 1981

[54] PRESSURE COMPENSATED SPOOL VALVE

[75] Inventor: Thomas L. Elliston, Ft. Worth, Tex.

[73] Assignee: Hydra-Rig, Inc., Fort Worth, Tex.

[21] Appl. No.: 88,774

[22] Filed: Oct. 29, 1979

[51] Int. Cl.[3] ..... F15B 13/04

[52] U.S. Cl. ..... 137/613; 91/446; 137/596.1; 137/596.2

[58] Field of Search ..... 91/446; 137/596.1, 596.2, 137/613

[56] References Cited

U.S. PATENT DOCUMENTS

| | | |
|---|---|---|
| 3,129,645 | 4/1964 | Olmsted . |
| 3,323,421 | 6/1967 | Olmsted . |
| 3,435,851 | 4/1969 | Olmsted . |
| 3,968,813 | 7/1976 | Olmsted . |

*Primary Examiner*—Gerald A. Michalsky

*Attorney, Agent, or Firm*—Hubbard, Thurman, Turner, Tucker & Glaser

[57] ABSTRACT

A control valve for actuating a double acting hydraulic jack or lift cylinder features a pressure compensator assembly for limiting the rate of retraction of the cylinder and piston relative to each other under heavy loading conditions to prevent dropping a load or letting the load get out of control. Pressure compensation is provided by a floating piston which is movably coupled in releasable engagement with a spool, wherein engagement of the piston with the spool defines a restricted flow path for limiting hydraulic flow out of the blind end of the cylinder to tank during retraction. According to a preferred embodiment, the spool is provided with a plurality of notches defining restricted flow passages which are covered and uncovered by the piston as it moves into and out of engagement with the spool. A compression spring is coupled between the piston and the spool for biasing the piston for movement away from the spool. The piston is provided with axially spaced pressure faces whose effective areas are balanced with respect to each other for driving the piston against the spring to a hydraulic detent position in which the notches are exposed. As the valve assembly opens to increase the orifice area of the notches, a pressure drop occurs across the notches, and the piston is held in equilibrium in the detent position as the forces developed by the piston pressure faces and by the spring balance each other. Variations in the cylinder port hydraulic pressure are compensated by the piston to maintain a constant pressure drop across the notches as it moves to choke off or throttle flow through the notches in response to the forces developed by the spring and pressure faces.

11 Claims, 8 Drawing Figures

PRESSURE COMPENSATED SPOOL VALVE

BACKGROUND OF THE INVENTION

1. Field of the Invention

The present invention relates generally to control valves and in particular to a pressure compensated spool valve for actuating a hydraulic cylinder which features a pressure compensator assembly for limiting the rate of movement of the cylinder and piston relative to each other under heavy loading conditions.

2. Description of the Prior Art

A double-acting hydraulic jack or lift cylinder is commonly used in a number of applications in which it is necessary to raise and lower heavy loads. Many types of valves are available for controlling the operations. One commonly available control valve is the five port shuttle valve for selectively applying high pressure hydraulic fluid from a supply line to either the head end or the rod end of a lift cylinder to produce extension or retraction, respectively. In this arrangement, the control valve includes a housing having a bore, a supply port for connection to a high pressure hydraulic source, rod and head cylinder ports, and a pair of return ports for connection to an exhaust tank. A spool is received in slidable engagement with the housing bore and is reciprocably movable through the bore from a neutral position blocking the supply port to first and second discharge positions opening the supply port for discharge through the bore into one of the rod and head cylinder ports. The control valve spool is normally provided with a mechanical centering spring to maintain the valve in the non-actuating position in which the supply port is blocked in the absence of a shifting force. Movement of the spool from the neutral or non-actuating position is provided by a pilot actuator, either hydraulically or pneumatically controlled. Shifting of the spool by the pilot actuator in one direction causes the supply port to be connected in communication with the head end of the cylinder when extension is desired, and shifting the spool in the opposite direction opens the supply port for discharge into the rod end of the cylinder when retraction is desired.

According to a common arrangement, the hydraulic jack or lift cylinder is provided with a piston/rod assembly which is fixed and a lift cylinder which is reciprocally movable with respect to the piston and rod. During the extension mode, the exhaust fluid from the rod end of the cylinder is discharged through the rod port into a tank exhaust return port and provides make-up fluid for pressurizing the head end. During the retraction mode, exhaust fluid from the head end is discharged through the head port and provides make-up fluid for pressurizing the rod end. The rate of movement of the lift cylinder relative to the rod and piston is proportional to the rate at which the cylinder is pressurized and the magnitude of the load being lifted.

A constant delivery pump is normally used for developing supply hydraulic pressure. Therefore in the lifting mode the rate of extension of the lift cylinder relative to the rod and piston for a given load is predictable and will gradually decrease as the load increases. However, as a load is being lowered, the rate of retraction of the lift cylinder relative to the rod and piston increases as the load increases. As the magnitude of the load carried by the cylinder continues to increase, the retraction rate may exceed safe limits and cause overheating of the hydraulic fluid or structural damage to the lift cylinder as the piston head collides with the lift cylinder, and also possibly causing damage to the load as the piston and cylinder suddenly collide in a runaway condition.

In the operation of a drilling rig in which a double acting hydraulic lift cylinder is used for lifting and lowering a drill string in a well bore, the load imposed on the hoist rig may range from a few thousand pounds to several thousand kips as additional lengths of tubing are connected into the drill string. Additionally, the drill bit and drilling collars together with other downhole equipment impose an additional substantial load on the drill string. Because the overriding concern to get the drill string into and out of the well as rapidly and safely as is economically possible, the lift cylinder is exposed to severe duty cycles. For example, the rig operator, in order to obtain maximum efficiency, will operate the hoist equipment at maximum speed. A crew member is apt to lower the drill string at free fall velocity to within a few feet of the stroke limit and then suddenly apply braking force to stop the drill string. Such an operation can impose extreme shock loads due to the deacceleration of the heavy pipe moving at high velocity. Although conventional masts are designed with a safety factor of three or four to withstand shock loading, as the length and weight of the drill string increases, the likelihood of a damaging shock load under free fall conditions substantially increases.

If the traveling block of the hoist rig is descending rapidly, the lift cylinder will be retracting as hydraulic fluid is introduced into the rod end of the cylinder. To suddenly stop the load, the operator will return the control valve to the neutral position, thereby blocking pressure flow to the cylinder and also blocking return flow which will have the effect of quickly deaccelerating the piston within the hydraulic cylinder. A relief valve is usually connected within the control system to prevent damage to the hydraulic system should the rig operator permit the load to fall at an uncontrolled rate. Although the relief valve will prevent damage to the hydraulic system, the derrick and other hoist equipment may be subjected to a substantial shock load, and there is a risk of a damaging impact which could shear the slips and cause the drill string to be dropped into the well bore should a sufficiently heavy drill string load be allowed to fall without control.

SUMMARY OF OBJECTS OF THE INVENTION

It is, therefore, the principal object of the present invention to provide a pressure compensated control valve for actuating a double acting hydraulic cylinder and for limiting the rate of movement of the cylinder and piston relative to each other under heavy loading conditions to prevent dropping a load or letting the load get out of control.

A related object of the present invention is to provide a pressure compensated spool valve of simple design and rugged construction, having few parts and capable of extended duty while withstanding the extreme conditions of hard usage and exposure to which equipment of this character is customarily subjected.

Another important object of the present invention is to provide a pressure compensated control valve in which exhaust flow from the lift cylinder is discharged through a regulated flow passage having variable dimensions which are controlled by moving components relative to each other within the flow passage without physical distortion of the components.

Yet another object of the invention is the provision of a pressure compensated control valve which permits unrestrained discharge from a supply port to the hydraulic lift cylinder in the lifting mode but which is operable for limiting the flow in the lowering mode after the hydraulic pressure exceeds a predetermined threshold value.

SUMMARY OF THE INVENTION

The foregoing objects are provided by a control valve which includes a housing having a bore, a supply port for connection to a high pressure source of hydraulic fluid, rod and head cylinder ports, and a pair of return ports for connection to an exhaust tank. A spool is received in slidable engagement with the housing bore and is reciprocally movable through the bore from a neutral position blocking the supply port to first and second discharge positions opening the source port for discharge through the bore into a selected one of the rod and head cylinder ports. The control valve spool is provided with a mechanical centering spring to maintain the valve in the non-actuating position in which the supply port is blocked in the absence of a shifting force. Movement of the spool from the neutral or non-actuating position is provided by a pneumatically controlled pilot actuator. Shifting of the spool by the pilot actuator in one direction opens the supply port for discharge into the head end of the cylinder and connects the rod end to a return port when extension is desired, and shifting the spool in the opposite direction opens the supply port for discharge into the rod end of the cylinder and connects the head end to a return port when retraction is desired.

Pressure compensation in the load lowering mode is provided by a floating piston which is movably coupled in releasable engagement with the spool, wherein engagement of the piston with the spool defines a restricted flow path for limiting hydraulic flow out of the head end of the cylinder to the exhaust tank during retraction. The spool is preferably provided with a plurality of notches defining restricted flow passages which are covered and uncovered by the piston as it moves into and out of engagement with the spool. A compression spring is coupled between the piston and the spool for biasing the piston for movement away from the spool. The piston is provided with axially spaced pressure faces whose effective areas are balanced with respect to each other for driving the piston against the spring to a hydraulic detent position in which the notches are exposed thereby producing a restricted flow path. As the valve assembly opens to increase the orifice area of the notches, a pressure drop occurs across the notches, and the piston is held in equilibrium in the detent position as the forces developed at the pressure faces of the piston and by the spring balance each other. Variations in the cylinder head pressure are compensated by movement of the piston relative to the spool to maintain a substantially constant pressure drop across the notch orifice openings as the piston moves to choke off or throttle the flow through the notches in response to the forces developed by the spring and pressure faces.

The floating piston and spool are provided with mutually engagable valve portions defining a restrictive flow path for limiting hydraulic flow from the head port to the exhaust port as the spool moves from the blocking position toward the open port position. The valve portions preferably comprise a detent portion having flow restriction notches intersecting the end of the spool, and a sealing cavity formed on the end of the piston for receiving the detent portion in slidable sealing engagement. The union of the piston and spool partitions the bore into a detent chamber for communicating with the cylinder head port and a transfer chamber for communicating with the return port. The notched flow passages are covered and uncovered by the piston as it moves into and out of engagement with the spool. The piston is provided with axially spaced pressure faces whose effective areas are balanced with respect to each other for driving the piston against the spring to a hydraulic detent position in which the notches are exposed thereby producing the restricted flow path and the desired drop.

According to a preferred arrangement, the spool is provided with a set of detent notches which are axially spaced with respect to the flow restriction notches and which collectively constitute the detent chamber. A flow passage is formed through the housing for connecting the cylinder head port in communication with the housing bore on the side of the piston opposite of the detent chamber. According to this arrangement, the cylinder head port pressure is applied to the compensator piston and drives it against the spring at any time the blind end cylinder pressure exceeds the force required to drive the spring into full compression.

As the spool is displaced in a direction which exposes the head port for discharge into a return port, the compensator piston follows the spool and shuts off fluid flow from the head port to the return port until the detent chamber is exposed to the head port. The detent notches which collectively comprise the detent chamber allow the cylinder head port pressure to be applied through the detent chamber against the valve and piston pressure face. The same pressure is also applied to the opposite piston pressure face through the housing flow passage. The area of the pressure face adjoining the detent chamber is larger than the effective piston area on the opposite end so that a larger force is developed which displaces the piston away from the spool, thereby exposing the flow restriction notches as the piston is withdrawn. The respective pressure face areas and the spring are dynamically balanced with respect to each other so that the pressure drop from the detent cavity into the transfer cavity is maintained at a predetermined level which is equivalent to the pressure developed by the compression spring.

As the piston opens in response to the differential force produced by the pressure faces to increase the orifice area of the flow restriction notches, a pressure drop occurs across the notches and the piston is held in equilibrium in the restricted flow path detent position as the forces developed by the pressure faces of the piston and by the spring balance each other. By limiting the pressure differential across the flow restriction orifice, the flow rate through the orifices remain substantially constant even though the cylinder head port pressure increases. As the head port pressure drops below the effective pressure level developed by the spring, the effect of the compression spring becomes dominant and completely opens the cylinder head port to the exhaust port under relatively low pressure conditions. However, for pressure conditions which exceed the threshold level of the spring, the compensator piston maintains the pressure differential and thereby limits the flow rate by choking or throttling the flow so that a runaway condition cannot exist.

The foregoing and other objects, features and advantages of the present invention will be more fully understood by reference to the following drawings, specification and appended claims.

DETAILED DESCRIPTION OF THE PREFERRED EMBODIMENTS

Figure 1:
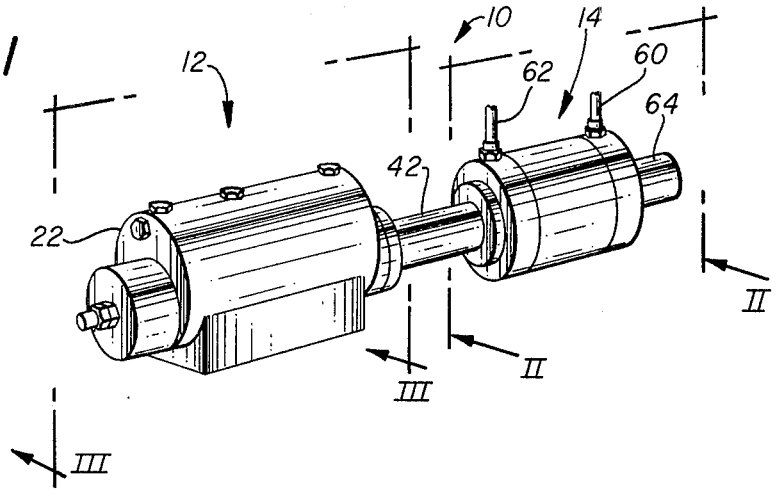
FIG. 1 is a perspective view of a pressure compensated control valve assembly constructed according to the teachings of the invention.

In the description which follows, like parts are marked throughout the specification and drawings with the same reference numerals, respectively. The drawing figures are not necessarily to scale and in some instances portions have been exaggerated in order to more clearly depict certain features of the invention. Operation of the preferred embodiments will be described with reference to a double acting hydraulic lift cylinder of the type commonly used for driving the draw works of a hoist rig for running a pipestring into and out of a well bore. However, the pressure compensated control valve assembly of the invention may be used to good advantage in any application in which it is necessary to raise and lower heavy loads.

Figure 3:
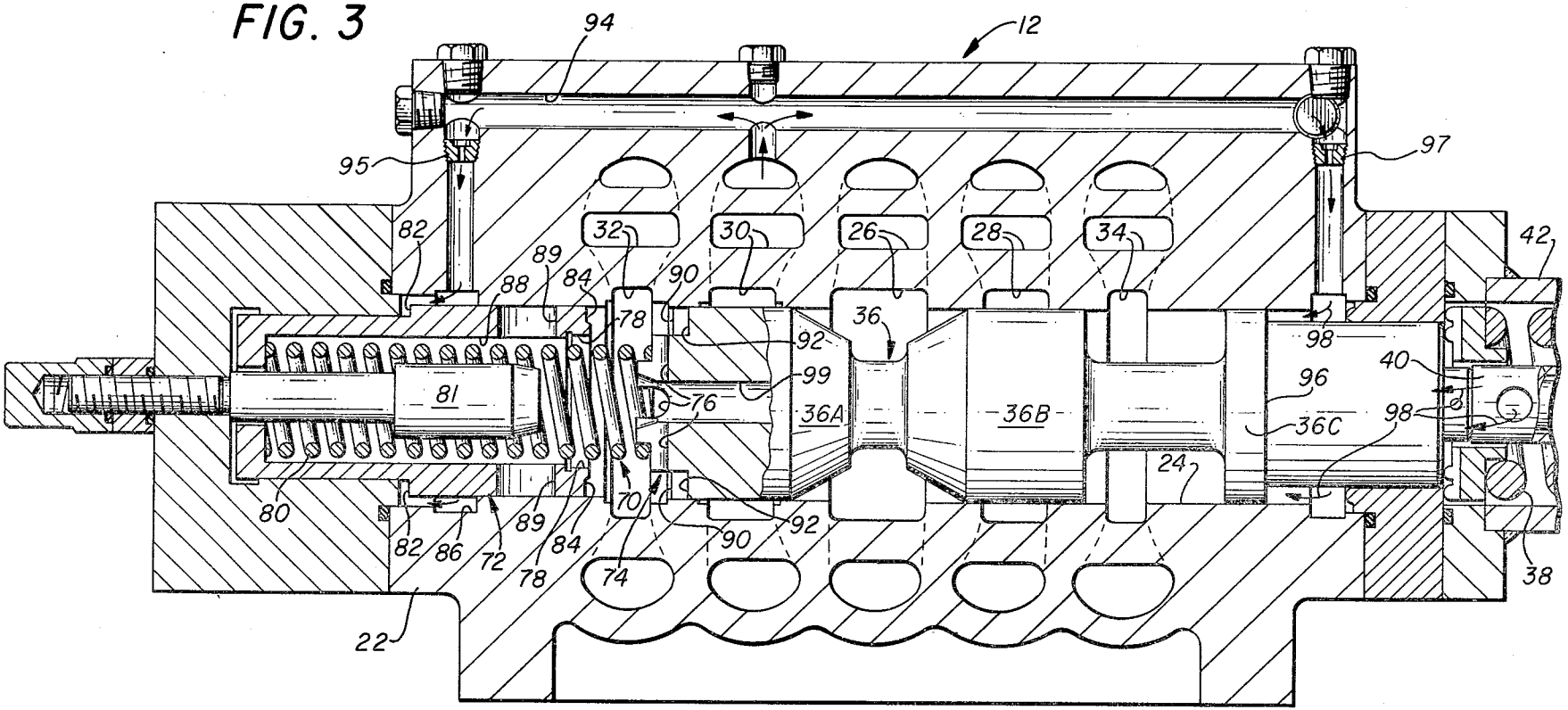
FIG. 3 is a partial view, in section, of a pressure compensated spool valve, shown in the neutral position, and taken along the lines III—III of FIG. 1.
Figure 8:
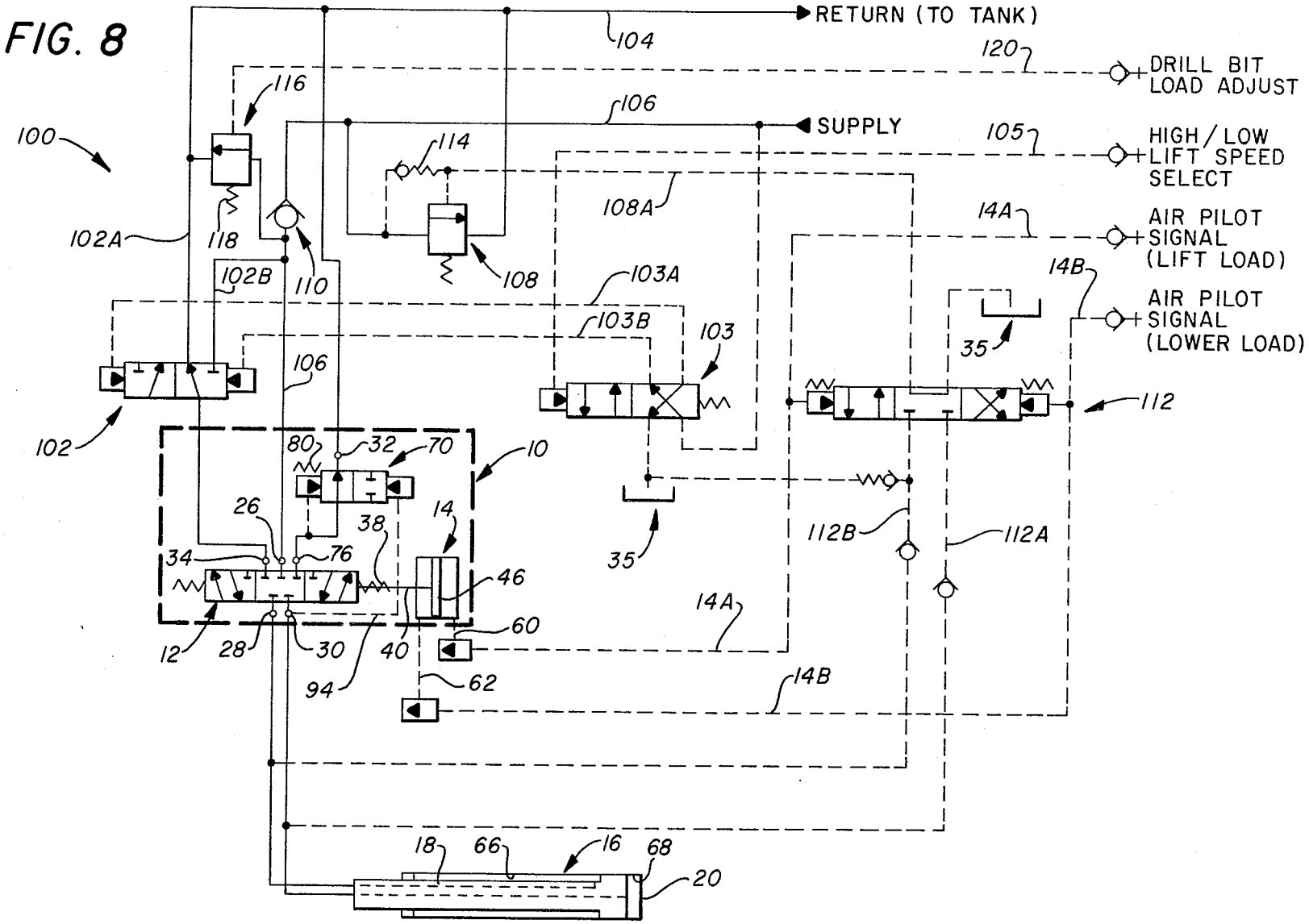

Referring now to the drawing, and more particularly to FIG. 1, a control valve assembly 10 includes a pressure compensated spool valve 12 mechanically coupled to a pneumatic pilot actuator 14. The pressure compensated spool valve 12 is a three position, five port assembly which controls the direction of movement of a double acting hydraulic lift cylinder 16 as illustrated in FIG. 8. The lift cylinder assembly 16 is provided with a piston/rod assembly 18 which is fixed and a lift cylinder housing which is reciprocally movable with respect to the piston and rod. The spool valve 12 is operable for selectively applying high pressure hydraulic fluid from a supply line to either the head end or the rod end of the lift cylinder 16 to produce extension and retraction, respectively. In this arrangement, the spool valve 12 includes a housing 22 having a bore 24, a supply port 26 for connection to a high pressure hydraulic source (not shown), a rod delivery port 28, a head delivery port 30, and a pair of return ports 32, 34 for connection to an exhaust tank 35. A spool 36 having axially spaced sealing surfaces 36A, 36B and 36C is received in slidable engagement with the housing bore 24 and is reciprocally movable through the bore from a neutral position as shown in FIG. 3 in which the head and rod ports are sealed by the surfaces 36A, 36B.

Figure 2:
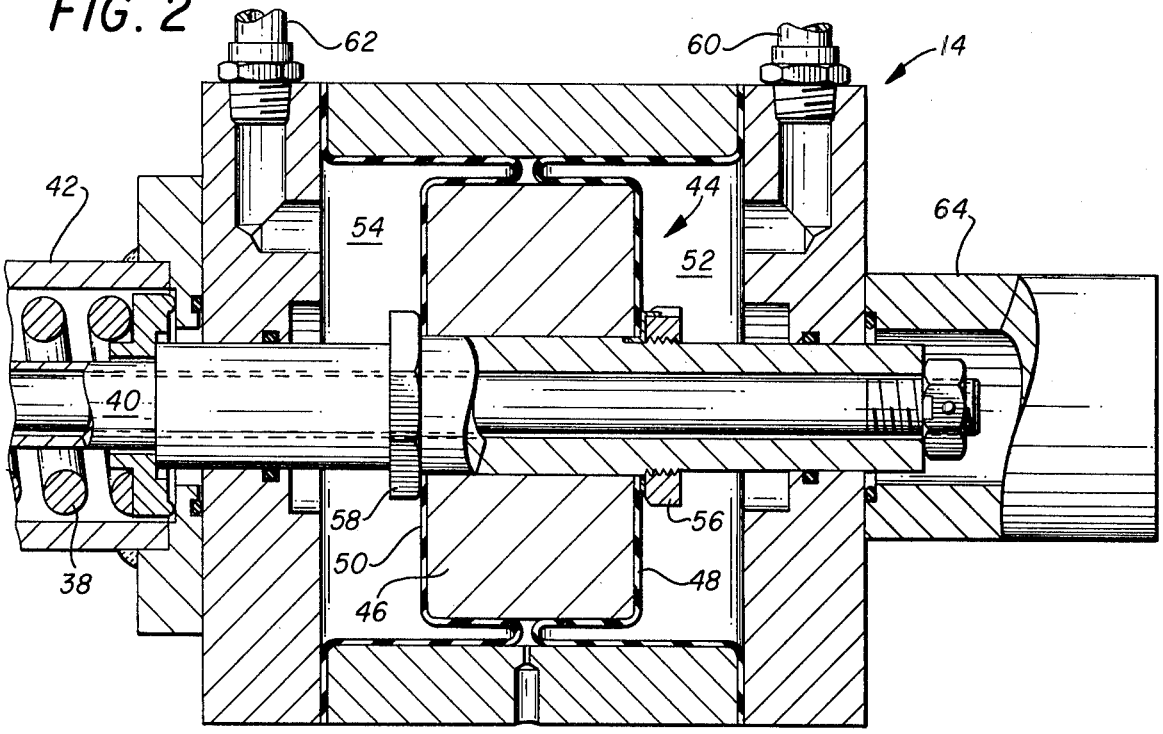
FIG. 2 is a sectional view of a pneumatically operated pilot actuator taken along the lines II—II of FIG. 1.
Figure 7:
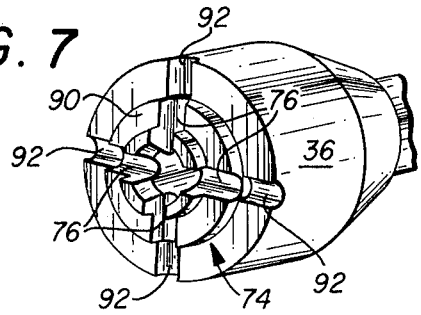
FIG. 7 is a perspective view of the notched detent portion of the spool; and, FIG. 8 is a schematic view of a hydraulic control system in which the pressure compensated control valve of the invention is incorporated for controlling the movement of a double acting hydraulic lift cylinder.

The control valve spool is provided with a mechanical centering spring 38 to maintain the spool in the neutral position in the absence of a shifting force. Movement of the spool 36 from the neutral position is provided by the pilot actuator 14 (FIG. 2) which is pneumatically controlled. The spool 36 is mechanically coupled to the pilot actuator through a control shaft 40. The control shaft 40 is housed within a spacer housing 42 and is encircled by the centering spring 38. Secured to the control shaft 40 is a rolling diaphragm piston assembly 44 which includes a piston 46 and a pair of concentrically mounted cylindrical diaphragms 48, 50 which cooperate with the piston 46 to form a rolling seal which partitions the pilot actuator 14 into a first pressure chamber 52 and a second pressure chamber 54. The resilient diaphragms 48, 50 are secured to the control shaft 40 and piston 46 by means of fasteners 56, 58. The pilot actuator 14 develops a driving force which displaces the control shaft 40 to the left in response to the delivery of high pressure air through delivery line 14A into the pressure chamber 52. An inlet port 60 is provided for this purpose. The control shaft is driven to the right in response to pressurization of the opposite pressure chamber 54 through delivery line 14B. An inlet port 62 is provided for this purpose. The control shaft 40 is displaced through the spacer housing 42 and through a shuttle housing 64. O-ring seals 66 lodged in the actuator housing provide a sliding seal between the actuator housing and the control shaft. Shifting of the spool 36 by the pilot actuator 14 to the left causes the supply port 26 to be connected in communication with the head end of the cylinder with the rod end being connected to a return port when extension is desired, and shifting the spool 36 to the right opens the supply port for discharge into the rod end of the cylinder and connects the head end to a return port when retraction is desired.

According to the arrangement shown in FIG. 8, the piston/rod assembly 18 is fixed and the lift cylinder 20 is reciprocally movable. During the extension mode, exhaust fluid from the rod pressure chamber 66 is discharged through the rod port 28 into the tank return port 34 and provides make-up fluid for pressurizing the head pressure chamber 68. When the retraction mode is initiated, exhaust fluid from the head pressure chamber 68 is discharged from the head port 30 into the tank return port 32 and provides make-up fluid for pressurizing the rod pressure chamber 66.

As a drill string load is being lowered by draw works coupled to the hydraulic lift cylinder 16, the rate of retraction of the lift cylinder 20 relative to the rod and piston assembly 18 increases as the magnitude of the load increases. As the magnitude of the load carried by the cylinder is increased as additional length of tubing are added to the pipestring, the retraction rate may exceed safe limits and cause overheating of the hydraulic fluid or structural damage to the hydraulic lift cylinder assembly as the piston collides with the lift cylinder, and also possibly causing damage to the load as the piston and cylinder suddenly collide in a run-away condition. The rate of retraction of the cylinder relative to the piston is proportional to the rate at which hydraulic fluid is discharged through the exhaust port 32. Because the effective discharge area of the exhaust port 32 is fixed, the rate of descent of the pipestring will become increasingly greater as additional lengths of tubing are connected into the pipestring. As the length and weight of the drill string increases, the likelihood of a damaging shock load under free fall condition substantially increases. Additionally, there is the risk of a damaging impact which could shear the slips and cause the pipestring to be dropped into the well bore should a sufficiently heavy pipestring load be allowed to fall without restraint.

The rate at which hydraulic fluid is discharged from the head pressure chamber 68 into the return port 32 is regulated, according to the present invention, by a pressure compensator assembly 70 (FIG. 3). The pressure compensator assembly 70 includes a floating piston 72 which is movably coupled in releasable engagement with a detent portion 74 of the spool 36. The detent portion is provided with a plurality of radial notches 76 which define restricted flow passages through the end of the spool 36. A sealing cavity 78 is formed on the end of the piston 72 for receiving the detent portion 74 in slidable, sealing engagement. The flow restriction notches 76 are covered and uncovered by the piston 72 as it moves into and out of engagement with the detent portion 74.

A compression spring 80 is coupled between the piston 72 and the face of the detent portion 74 for biasing the piston for movement away from the spool. Retraction of the piston is limited by a mechanical stop 81. The piston 72 is provided with a pair of axially spaced, annular pressure faces 82, 84 whose effective areas are balanced with respect to each other for driving the piston 72 against the compression spring 80 to a hydraulic detent position (FIG. 6) in which the flow restriction notches 76 are exposed, thereby producing a restricted flow path. As the piston moves to the left thereby opening the effective orifice area of the notches 76, a pressure drop occurs across the notches, and the piston 72 is held in equilibrium in the hydraulic detent position as the forces developed at the opposite piston pressure faces 82, 84 and by the spring 82 balance each other. Variations in the head pressure chamber 68 which appear at the head port 30 are compensated by movement of the piston relative to the spool to maintain a substantially constant pressure drop across the notch orifice openings 76 as the piston moves to choke off or throttle flow through the notches in response to the forces developed by the spring and pressure faces.

Figure 4:
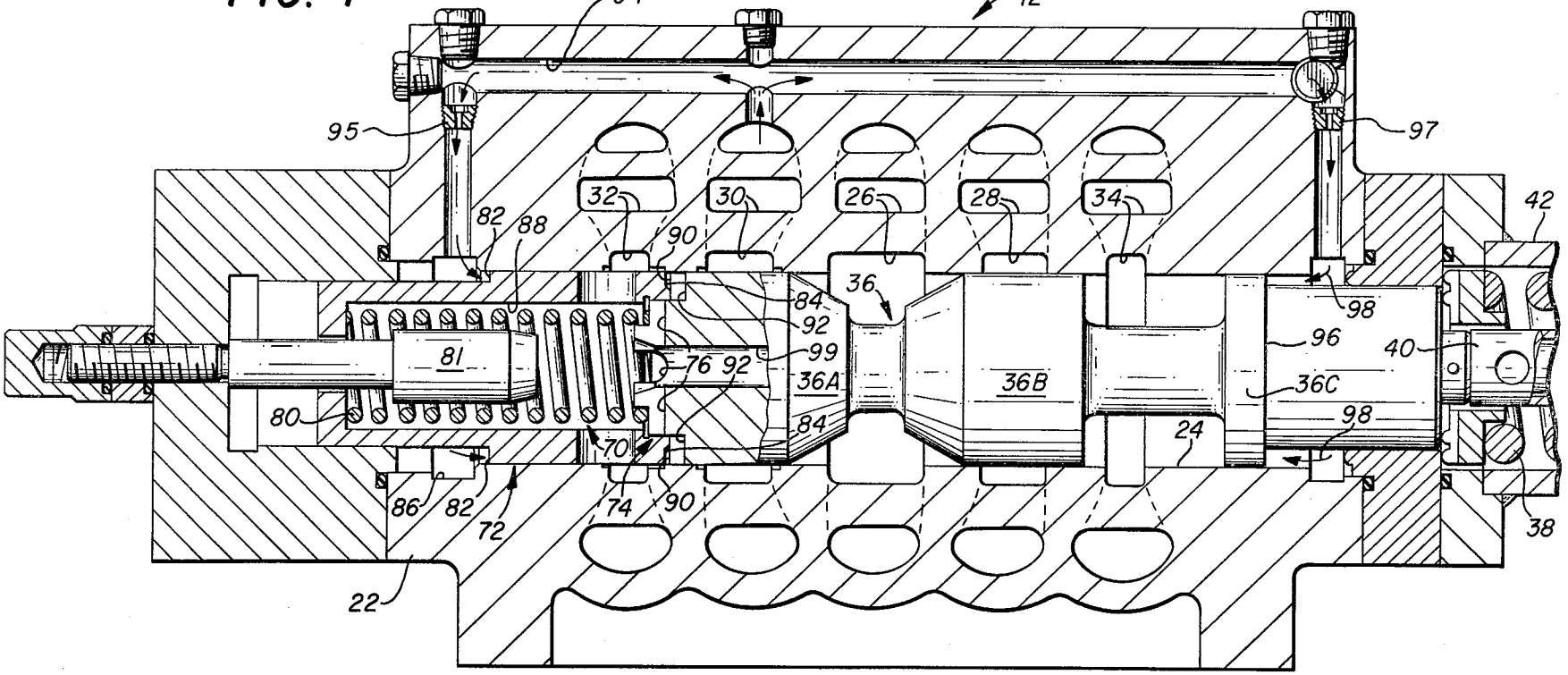
FIG. 4 is a view similar to FIG. 3 which illustrates engagement of a piston and spool when the shuttle valve is in the neutral position.

The compensator piston 72 is constructed to restrict and orifice the flow passages from the head port 30 to the return port 32 in the lowering mode. Referring to FIG. 4, the pressure in the head port 30, which is the blind end cylinder pressure, is communicated into the annulus 86 behind the compensator piston 72 and forces it to the right against the spring 80 which is concentrically disposed within a central bore 88 of the piston. The piston 72 is also provided with radial vent openings 89 which communicate with the bore 88. The central bore 88 and vent openings 89 collectively define a transfer chamber. The compensator piston is driven into contacting engagement with the face 90 of of the detent portion 74 at any time there is a pressure greater than the level required to produce full deflection of the spring 80.

According to a preferred arrangement, this pressure level is selected to be 100 psi. As the main spool is deflected to the right which connects the head port 30 to the tank return port 32 (FIG. 5), the compensator piston follows the main spool 36 and prevents flow from the head port 30 to the return port 32 until the head port 30 is exposed to the detent portion 74. A plurality of detent notches 92 intersect the detent portion 74 and are axially spaced with respect to the flow restriction notches. The detent notches 92 collectively constitute a detent chamber. As the spool 36 is displaced to the right, thereby exposing the head port 30 for discharge into the return port 32, the compensator piston 72 follows the spool and shuts off fluid flow from the head port to the return port until the detent notches 92 are exposed to the head port. The detent notches 92 allow the cylinder head port pressure to be applied through the detent chamber against the piston pressure face 84. The same pressure is also applied to the opposite piston pressure face 82 through a housing flow passage 94. Orifice plugs 95, 97 lodged in the flow passage 94 dampen any oscillations or instabilities that might occur between the compensator spool and the main spool.

The effective area of the pressure face 84 adjoining the detent notches 92 is larger than the effective area of the opposite piston face 82 so that a larger force is developed which biases the piston for movement away from the spool, thereby exposing the flow restriction notches 76 as the piston 72 is withdrawn. The respective pressure face areas are so balanced that the pressure drop from the detent notches into the transfer chamber is maintained at a predetermined level which is equivalent to the pressure developed by the compression spring 80.

Figure 5:
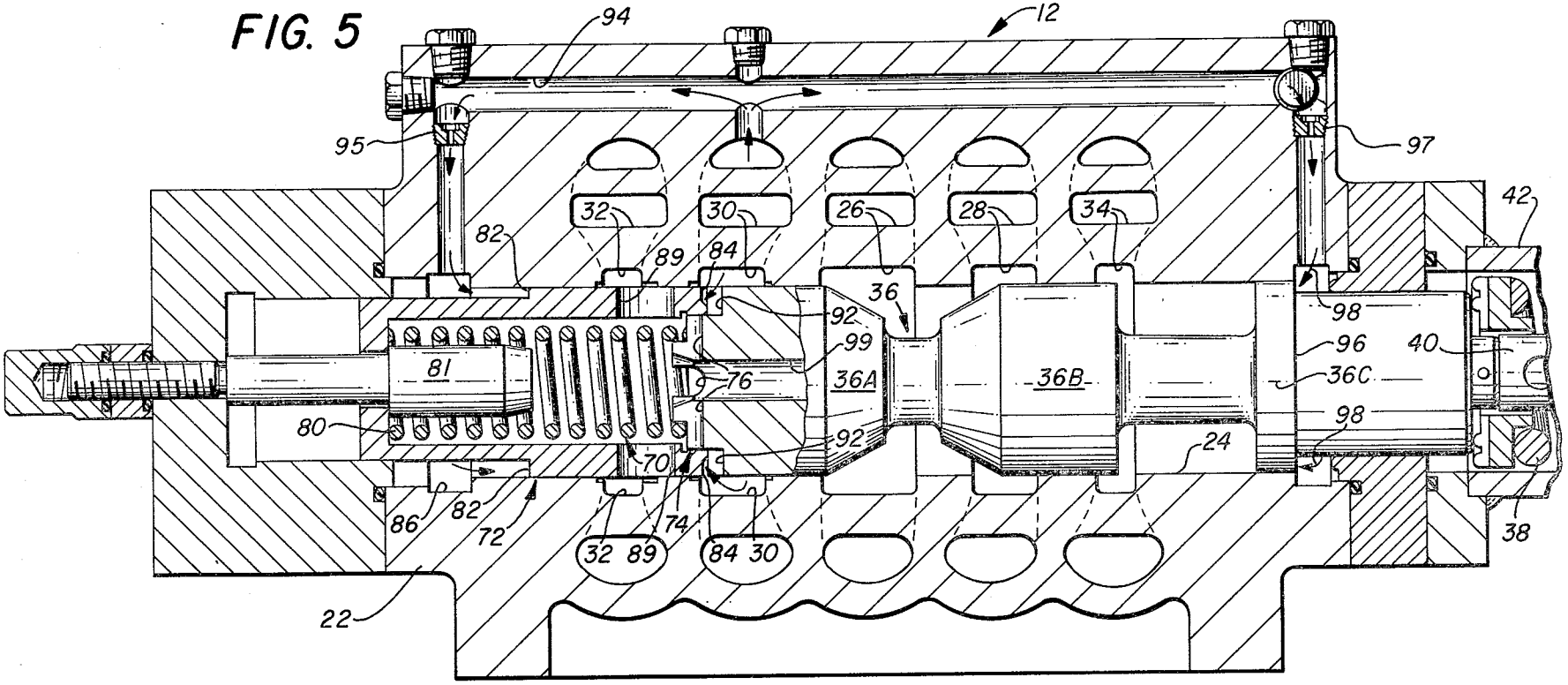
FIG. 5 is view similar to FIG. 4 which illustrates the relative position of the components as the spool is shifted to produce retraction of a double acting cylinder in a load lowering mode of operation.
Figure 6:
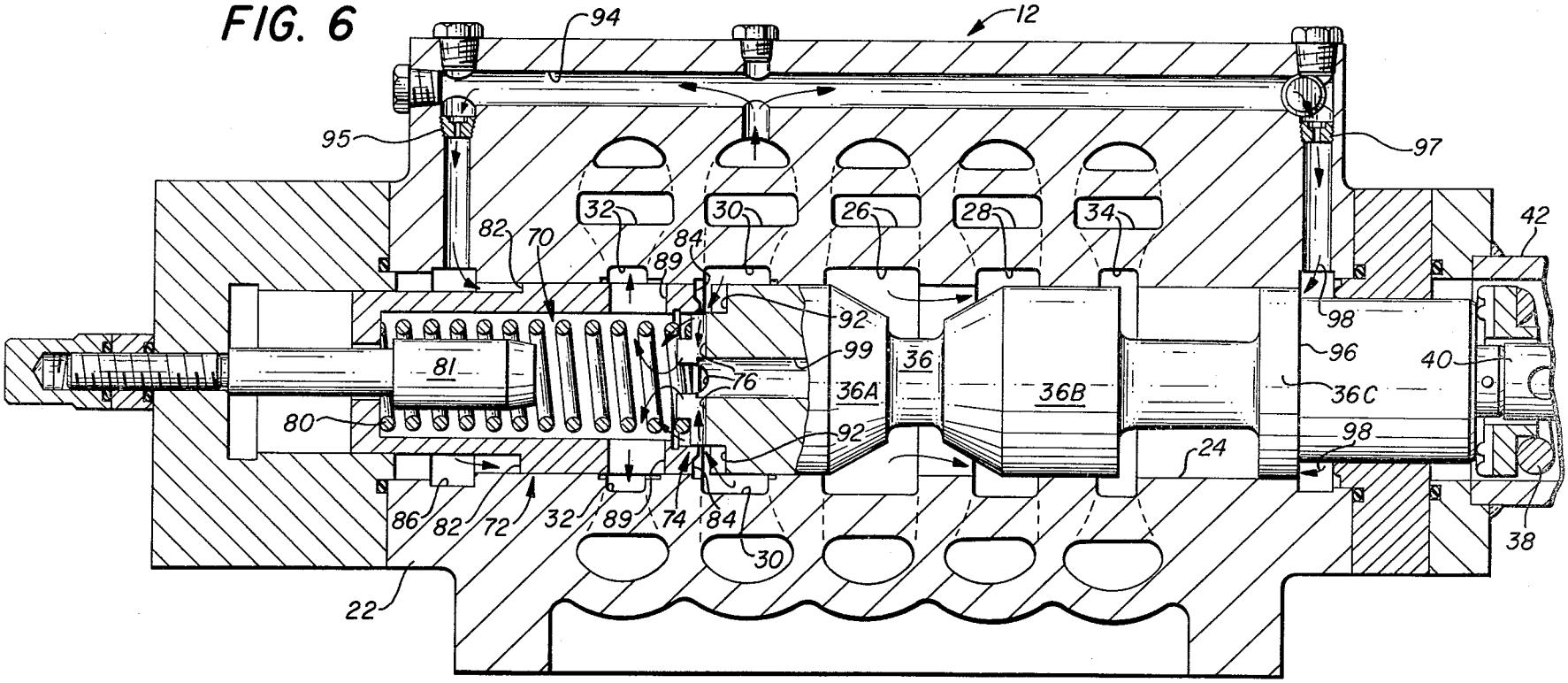
FIG. 6 is a view similar to FIG. 5 which illustrates hydraulically detented, pressure balanced engagement of the piston and spool which defines a restricted flow passage from the rod cylinder port to the exhaust tank in the load lowering mode.

As the piston 72 opens in response to the differential force produced by the pressure faces to increase the effective orifice area of the flow restriction notches 76, a pressure drop occurs across the notches and the piston is held in equilibrium in the hydraulic detent position as indicated in FIG. 6 as the forces developed by the pressure faces 82, 84 and by the spring 80 balance each other. The pressure force developed at the piston face 84 decreases as the effective area of the flow restriction notches 76 increase. The relative positions of the components immediately prior to opening the flow restriction notches 76 is illustrated in FIG. 5. In this condition, the flow restriction notches 76 are completely closed off by the bore of the sealing cavity 78.

At the onset of opening movement of the piston in response to the differential force produced by the pressure faces (FIG. 5), the effective orifice area of the flow restriction notches increases, thereby producing a pressure drop which gradually increases as the orifice area increases. Finally, the piston reaches a hydraulic detented equilibrium position (FIG. 6) in which the force of the spring plus the reduced force acting upon the pressure face 84 equals the force developed at the pressure face 82. In this condition, the forces developed by the pressure faces of the piston and by the spring balance each other. Variations in the head port hydraulic pressure are compensated by reciprocal movement of the piston to maintain a constant pressure drop across the flow restriction notches as it moves to choke off or throttle flow through the notches in response to the forces developed by the spring and pressure faces. By controlling the magnitude of the pressure differential across the flow restriction notches, the flow rate through the orifices remain substantially constant even though the cylinder head pressure increases. As the head port pressure drops below the effective pressure level developed by the spring, the effect of the compression spring 80 becomes dominant and completely opens the cylinder head port 30 to the exhaust port 32 under relatively low pressure conditions. However, for pressure conditions which exceed the threshold level of the spring 80, the compensator piston 72 maintains the pressure differential and thereby limits the flow rate by choking or throttling the flow so that a run-away condition cannot exist.

If there is no pressure in the head port 30, which is connected to the blind end 68 of the cylinder, then there is no risk of a run-away condition since there is no weight hanging on the cylinder 16. If there is a load applied to the lift cylinder, there is a high pressure in the blind end 68, and that pressure is applied behind the compensator piston 72 against the pressure face 82 which drives the piston against the detent portion 74. This pressure is also applied to the right end of the spool along an annular pressure face 96 as indicated by the arrows 98 so that an unbalance will not occur. The spacer housing 42 in which the centering spring 38 is enclosed is also pressurized by the head port pressure through a flow passage 99 extending through the spool 36. The effective areas of the annular faces 82, 96 are the same so that the spool 36 will remain centered in the neutral position as shown in FIG. 3 until it is moved by the pneumatic actuator 14. If it is desired to lower a load that is coupled to the lift cylinder, a pressure signal is transmitted to the inlet port 62 of the pneumatic actuator 14 to move the control shaft 40 to the right which uncovers the head port 30 which would attempt to vent the head port 30 directly to tank. However, the compensator piston 72 is driven to the hydraulic detent position (FIG. 6) which throttles the flow between the head port 30 and exhaust port 32 as described above. By regulating the pressure drop through the flow restriction notches 76, the flow rate is maintained at a predetermined level, and in turn the maximum retraction rate of the cylinder relative to the piston is controlled so that a run-away condition cannot exist, regardless of the magnitude of the load being handled by the draw works.

Referring now to FIG. 8, the control valve assembly 10 is shown incorporated within a hydraulic system 100 which coordinates the delivery of high pressure hydraulic fluid from a constant delivery source such as a rotary gear pump (not shown) to the hydraulic lift cylinder 16 and return to an exhaust tank (not shown). The pressure compensated control valve assembly 10 controls the extension and retraction of the hydraulic lift cylinder assembly 16 as previously discussed. At any given flow condition a fixed flow rate is established between the source and the control valve assembly 10. Depending upon the routing of the hydraulic fluid as it is returned to tank, two block speeds can be obtained with only one flow rate. To obtain the lowest speed and highest lifting force, hydraulic fluid is vented directly from the rod port 28 to the head port 30. This arrangement delivers hydraulic fluid to the blind end of the cylinder and the fluid from the rod end is vented back out from the rod end to the return port 34 through a regeneration valve 102. The valve is placed in the low mode by actuating a speed selection valve 103 in response to a high/low speed signal 105, and in response to pressurization through signal line 103A, exhaust fluid from the rod port 28 from the rod end 66 of the cylinder is directed through the return port 34 and through the regeneration valve 102 directly to tank through a low speed conduit 102A and a return conduit 104 (as illustrated in FIG. 8). To obtain a higher speed and a lower lifting capability, the regeneration valve 102 is shifted to its other position, that is to the right, in response to pressurization through signal line 103B, in which case the return fluid from the rod port 28 is directed to the return port 34 through the regeneration valve 102, and through a high speed conduit 102B connected to the main supply conduit 106 which forces all of the hydraulic fluid in the rod end chamber 66 back into the blind end 68 through the rod port 28 to the head port 30. In this situation, in addition to the fluid from the power pack being delivered to the blind end chamber 68, the fluid being discharged out of the rod end chamber 66 is directed through the regeneration valve 102 to the blind end chamber 68, thereby joining the power pack fluid to increase the lifting speed. The lifting speed will be increased in proportion to the ratio of the effective rod end piston area to the blind end piston area. If that area ratio is 2 : 1, then the regeneration speed will be doubled. The area ratio of the cylinder defines the ratio of speed increase that is obtained by regenerating or putting the rod end fluid into the blind end in addition to the power pack fluid.

If the traveling block of the hoist rig is descending rapidly, the lift cylinder 20 will be retracting as hydraulic fluid is introduced into the rod end 66 of the lift assembly 16. To suddenly stop the load, the operator will return the control valve to the neutral position, thereby blocking pressure flow to the cylinder and also blocking return flow which will have the effect of quickly de-accelerating the cylinder. A relief valve 108 is connected upstream of a check valve 110 to prevent damage to the hydraulic system 100 should the rig operator return the control valve 10 the neutral position near the end of a stroke under heavy loading conditions.

In order to minimize system transients which arise in response to a transition from zero to full flow, an air pilot transition control valve 112 causes the main relief valve 108 to be referenced to either the rod end pressure or the head end pressure of the main lift cylinder 16 depending on which direction the main lift cylinder is moving. That is, if the blind end chamber 68 is pressurized to extend the main lift cylinder, then the pressure in the head port 30 is connected to the pilot port pressure of the main relief valve 108 through signal line 112A and relief pilot line 108A. If the spool is shifted to pressurize the rod port 28 to retract the main cylinder, then the rod port 28 pressure is connected to the pilot port pressure of the main relief valve 108 through signal line 112B and the relief pilot line 108A. The purpose of this arrangement is to soften the transition from zero to full flow. The main relief valve 108 is biased by a spring 114 at a predetermined pressure level, for example 150 psi, above the pressure in the supply line 106, so that by referencing the pilot line 108A to the particular side of the cylinder which is under pressure, a predetermined pressure drop, for example 100 psi, can be maintained between the incoming pressure and the selected cylinder port. That is, the incoming pressure will be maintained at 100 psi above the pressure in the cylinder, regardless of mode, at all times. Then when the pilot air signals are completely removed and the spool 36 is shifted to the neutral position by the centering spring 40, the main relief valve 108 is actuated to the full open position because the transition control valve 112 in the neutral mode has dumped the pilot pressure of the main relief valve 108 directly to the tank.

With the tank as a reference, the main relief valve 108 will be actuated to wide open condition and allow the power pack fluid from the supply to dump directly into the return line 104 to the tank. This particular operation is necessary because the main control valve 10 is completely closed in the neutral position. If this pressure relief was not provided for in the neutral position, the power pack would quickly load up to an extremely high pressure level, for example 3,000 psi, and would create a considerable amount of heat. Under these conditions, the power pack would be completely loaded even when no work was being done. Because the main control valve assembly 10 has a closed neutral position, a path to tank must be provided when that valve is in the neutral position, which is brought about by the combination of the transition control valve 112 and the main relief valve 108. The main relief valve 108 therefore performs a dual function as a pressure compensator when using fluid from the main supply.

An additional function of the check valve 110 is to prevent the main flow from returning to the power pack through the supply line 106 in case of an engine failure. In the event of an engine failure with the pressure compensated spool valve in an open condition, hydraulic flow could return to the power pack through the supply line and drop the load if the check valve 110 were not in the line.

When the hydraulic lift cylinder 16 forms a part of the draw works for a drilling rig, it is desirable to maintain a predetermined pressure load on the drill bit during a drilling operation. Automatic drilling control is provided by a pressure relief valve 116 which is connected across the supply conduit 106 and return conduit 104. The relief valve 116 includes a bias spring 118 which is manually adjustable through a pressure control signal line 120. The procedure is to pull the control handle to the up position which would normally pick up the load off of the drill bit and then decrease the setting of spring 118 manually until the load begins to go down instead of up while maintaining the handle in the up position. As the load drops due to the fact that pressure cannot be maintained, it will stop going down when the bit engages the formation. When the bit engages the formation and the load is decreased, the bit will hesitate and it will have a predetermined bit load depending upon the manual setting of the relief valve 116. As the drilling is continued and the formation is drilled from under the bit, the setting of the relief valve 116 will allow the traveling block to follow the bit down automatically and maintain a constant pressure on the bit. According to this arrangement, the bit load is automatically adjustable from zero load to full load. The automatic driller control relief valve 116 will maintain the pressure differential while the bit is drilling through the formation and will not let the load on the bit get too heavy or too light. It will maintain the set differential and will follow the bit down.

Although the invention as disclosed in the foregoing description of a preferred embodiment has particular utility for well drilling operations, those skilled in the art will appreciate that the apparatus of the invention may be used to good advantage in other fields of application in which it is necessary to lift and lower a heavy load. It should be apparent, therefore, that various changes, substitutions and alterations can be made without departing from the spirit and scope of the invention as defined by the appended claims.

What is claimed is:

1. In a hydraulic spool valve of the type including a housing having a bore, a delivery port and an exhaust port communicating with the bore, and a spool received in slidable sealing engagement with the housing bore and reciprocably movable through the bore between a first position blocking the delivery port and a second position opening the delivery port for discharge through the bore into the exhaust port, the improvement comprising;

a floating piston movably coupled in releasable engagement with said spool, the engagement of said piston with said spool defining a restricted flow path for limiting hydraulic flow from said delivery port to the exhaust port as said spool moves from the blocking position toward the open position.

2. An improved spool valve as defined in claim 1, said floating piston and spool comprising mutually engagable fluid restriction means partitioning said bore into a detent chamber for communicating with the delivery port and a transfer chamber for communicating with the exhaust port, said piston and spool being movable to a detent position of engagement in which the mutually engagable fluid restriction means defines a restrictive fluid flow path from the detent chamber to the transfer chamber, and including hydraulically assisted detent means coupled to said piston for driving said piston to the detent position in response to pressurization of the delivery port.

3. An improved spool valve as defined in claim 2, said mutually engagable fluid restriction means comprising a detent portion carried by said spool and a sealing cavity formed in said piston for receiving said detent portion, said detent portion being intersected by an orifice interconnecting the detent and transfer chambers, said orifice being covered and exposed by said sealing cavity as said piston moves into and out of engagement with said detent portion.

4. An improved spool valve as defined in claim 3, said orifice comprising a notch extending radially through said detent portion.

5. An improved spool valve as defined in claim 2, said piston having a bore communicating with the sealing cavity and a vent opening connecting the piston bore in communication with the spool bore, the piston bore and vent opening collectively defining the transfer chamber.

6. An improved spool valve as defined in claim 2, said hydraulically assisted detent means comprising:

a compression spring coupled between said piston and said spool biasing said piston for movement away from said spool;

a pair of axially spaced pressure faces formed on said piston, one of said pressure faces defining a movable boundary of said detent chamber; and, a flow passage connecting the delivery port in communication with the housing bore behind the opposite pressure face for driving said piston against said compression spring and the force developed at the detent pressure face in response to pressurization of the delivery port.

7. An improved spool valve as defined in claim 6, wherein the effective area of said detent pressure face is greater than the effective area of said opposite pressure face whereby said piston is driven to a hydraulic detent position in which said mutually engagable fluid restriction means define said restrictive fluid flow path, and said piston being displaced relative to said spool to increase and decrease the effective orifice area of said restrictive fluid flow path in response to increase and decrease of delivery port pressure to maintain a substantially constant pressure drop across said restrictive fluid flow path throughout the range of detent engagement.

8. An improved spool valve as defined in claim 2, said mutually engagable fluid restriction means comprising a detent portion carried by said spool and a detent pressure face carried by said piston, said detent portion being intersected by an orifice which in combination with the detent pressure face defines said detent chamber.

9. A pressure compensated spool valve comprising, in combination:

a valve housing having a bore, a delivery port and an exhaust port communicating with the bore;

a spool received in slidable sealing engagement with the housing bore and reciprocally movable through the bore between a first position blocking the delivery port and a second position opening the delivery port for discharge through the bore into the exhaust port, said spool having a detent portion formed on one end and an orifice intersecting said detent portion, said orifice defining a restricted flow passage connecting the delivery port in communication with the housing bore as said spool moves from the first position toward the second position;

a floating piston slidably received in sealing engagement with the housing bore and reciprocably movable through the bore between extended and retracted positions relative to said spool, said floating piston having a bore defining a sealing cavity for receiving said detent portion in slidable sealing engagement for covering the orifice as said piston moves from the extended position toward the retracted position, and for exposing the orifice as said floating piston moves from the retracted position toward the extended position;

a compression spring coupled between said piston and said spool biasing said piston for movement toward the extended position; and, a flow passage connecting said delivery port in fluid communication with said housing bore on the side of said piston opposite of said sealing cavity.

10. A pressure compensated spool valve as defined in claim 9, including a detent orifice axially spaced with respect to said restricted flow passage orifice and partially intersecting said detent portion, and said piston having a pressure face forming a movable flow boundary for directing flow from said delivery port through said restricted flow passage.

11. A pressure compensated spool valve as defined in claim 9, said piston having first and second axially separated pressure faces, one of said pressure faces forming a movable flow boundary for directing flow from said delivery port through said restricted flow passage and for developing a driving force for moving said piston away from said spool in response to pressurization of the delivery port, and the other pressure face being exposed to pressurization by said flow passage for driving said piston against said compression spring and the force developed at the detent pressure face in response to pressurization of the delivery port.

* * * * *

UNITED STATES PATENT AND TRADEMARK OFFICE

CERTIFICATE OF CORRECTION

PATENT NO. : 4,257,456

DATED : March 24, 1981

INVENTOR(S) : Thomas L. Elliston

It is certified that error appears in the above—identified patent and that said Letters Patent is hereby corrected as shown below:

Column 4, line 14, insert -- pressure --, after "desired".

Signed and Sealed this

*Twenty-second* Day of *September 1981*

[SEAL]

*Attest:*

GERALD J. MOSSINGHOFF

*Attesting Officer*

*Commissioner of Patents and Trademarks*